US011453939B2

(12) United States Patent
Pike

(10) Patent No.: US 11,453,939 B2
(45) Date of Patent: Sep. 27, 2022

(54) HEAT TREATMENTS FOR IMPROVED DUCTILITY OF NI—CR—CO—MO—TI—AL ALLOYS

(71) Applicant: HAYNES INTERNATIONAL, INC., Kokomo, IN (US)

(72) Inventor: Lee Pike, Kokomo, IN (US)

(73) Assignee: Haynes International, Inc., Kokomo, IN (US)

( * ) Notice: Subject to any disclaimer, the term of this patent is extended or adjusted under 35 U.S.C. 154(b) by 109 days.

(21) Appl. No.: 16/761,330

(22) PCT Filed: Nov. 9, 2018

(86) PCT No.: PCT/US2018/059990
§ 371 (c)(1),
(2) Date: May 4, 2020

(87) PCT Pub. No.: WO2019/125637
PCT Pub. Date: Jun. 27, 2019

(65) Prior Publication Data

US 2021/0180170 A1 Jun. 17, 2021

Related U.S. Application Data

(60) Provisional application No. 62/584,340, filed on Nov. 10, 2017.

(51) Int. Cl.
*C22F 1/10* (2006.01)
*C22C 19/05* (2006.01)

(52) U.S. Cl.
CPC ..... *C22F 1/10* (2013.01); *C22C 19/055* (2013.01); *C22C 19/056* (2013.01); *C22C 2202/00* (2013.01)

(58) Field of Classification Search
CPC ..... C22F 1/10; C22C 19/056; C22C 19/055
See application file for complete search history.

(56) References Cited

U.S. PATENT DOCUMENTS

| | | | |
|---|---|---|---|
| 6,132,535 | A | 10/2000 | Okada et al. |
| 2006/0051234 | A1 | 3/2006 | Pike, Jr. |
| 2017/0101707 | A1 | 4/2017 | Kottilingam et al. |

FOREIGN PATENT DOCUMENTS

| | | | | |
|---|---|---|---|---|
| EP | 0787815 | A1 | 8/1997 | |
| EP | 2835434 | A2 * | 2/2015 | ..... C22F 1/10 |
| EP | 2835434 | A2 | 2/2015 | |
| WO | 2018071328 | A1 | 4/2018 | |
| WO | 2019125637 | A2 | 6/2019 | |

OTHER PUBLICATIONS

Written Opinion of the International Searching Authority for PCT/US2018/059990 dated Jul. 8, 2019.
International Search Report for PCT/US2018/059990 dated Jul. 8, 2019.
"Metals & Alloys in the Unified Numbering System", 13th Edition, Technical Library Haynes International Kokomo, SAE HS-1086/2017, ASTM DS56L, A Joint Publication, SAE International & ASTM International, Copyright 2017, p. 245.
"Influence of Heat Treatment on the Microstructure and Tensile Properties of Ni-base Superalloy Haynes 282" by Ceena Joseph, Christer Persson, Magnus Hörnqvist Colliander, Materials Science and Engineering A, 679 (2017) 520-530.

* cited by examiner

*Primary Examiner* — Jessee R Roe
(74) *Attorney, Agent, or Firm* — Buchanan Ingersoll & Rooney PC

(57) ABSTRACT

In a method for heat treating alloy compositions within UNS N07028 the alloy composition is heated at a temperature between 1550° F. and 1750° F. for at least two hours, and then heated at a lower temperature between 1300° F. and 1550° F. for at least two hours. The alloy composition may be heated at a temperature between 1850° F. and 1950° F. for at least one hour before heating the alloy composition at a temperature between 1550° F. and 1750° F.

17 Claims, 2 Drawing Sheets

Grain boundary layer (gamma-prime + $M_{23}C_6$) in 282® alloy after AHT2 heat treatment.

Grain boundary layer (only discrete $M_{23}C_6$) in 282® alloy after AHT1 heat treatment.

Grain boundary layer (only continuous $M_{23}C_6$) in 282® alloy after AHT0 heat treatment.

HEAT TREATMENTS FOR IMPROVED DUCTILITY OF NI—CR—CO—MO—TI—AL ALLOYS

FIELD OF THE INVENTION

This invention relates to heat treatments applied to a certain Ni—Cr—Co—Mo—Al—Ti alloy compositions within UNS N07208 which result in improved ductility compared to previously established heat treatments for the alloy. In particular, these heat treatments result in increased ductility at intermediate temperatures, e.g. around 1400° F. (760° C.). This is a critical temperature for the operation of components in gas turbine engines which require high ductility, particularly in aircraft engines.

BACKGROUND OF THE INVENTION

HAYNES® 282® alloy is a commercially available alloy within UNS N07208 used for many applications, most notably in components in both aero and industrial gas turbine engines. The compositional ranges for UNS N07208 and HAYNES® 282® alloy are the same and are set forth in Table 1. The compositional ranges for UNS N07208 and HAYNES® 282® alloy are the same and are set forth in Table 1. The alloy is nominally (in weight %) Ni-20Cr-10Co-8.5Mo-2.1Ti-1.5Al, but the defined compositional ranges of the alloy are given in Table 1. The alloy is notable for its unique combination of excellent creep strength, thermal stability, and fabricability. The superior fabricability of HAYNES® 282® alloy includes excellent hot workability, cold formability, and weldability (both strain-age cracking resistance and hot cracking resistance).

TABLE 1

Compositional Ranges of HAYNES ® 282 ® alloy and UNS N070208 (weight %)

| Element | Minimum | Maximum |
|---|---|---|
| C | 0.04 | 0.08 |
| Mn | — | 0.3 |
| Si | — | 0.15 |
| P | — | 0.015 |
| S | — | 0.015 |
| Cr | 18.5 | 20.5 |
| Co | 9.0 | 11.0 |
| Mo | 8.0 | 9.0 |
| W | — | 0.5 |
| Cb (Nb) | — | 0.2 |
| Ti | 1.90 | 2.30 |
| Ta | — | 0.1 |
| Al | 1.38 | 1.65 |
| B | 0.003 | 0.010 |
| Fe | — | 1.5 |
| Cu | — | 0.1 |
| Zr | — | 0.020 |
| Ni | remainder | |

To achieve the excellent creep strength, 282® alloy is used in the age-hardened condition. The main objective of the age-hardening heat treatment is to precipitate/grow the gamma-prime phase resulting in increased material strength/hardness (a process called age-hardening). Typically, the age-hardening treatment is applied to the alloy after it has been fully fabricated into a component and subjected to a post-fabrication "solution anneal". Solution annealing temperatures for 282® alloy are typically in the range of 2000 to 2100° F. The "standard age-hardening" treatment for 282 alloy is 1850° F. for 2 hours plus 1450° F. for 8 hours. This heat treatment has been described in introductory papers on 282® alloy (See, for example, L. M. Pike, "*HAYNES* 282 *alloy—A New Wrought Superalloy Designed for Improved Creep Strength and Fabricability", ASME Turbo Expo* 2006, paper no. GT2006-91204, ASME Publication, New York, N.Y., 2006. and L. M. Pike, "*Development of a Fabricable Gamma-Prime* (γ') *Strengthened Superalloy", Superalloys* 2008—*Proceedings of the* 11$^{th}$ *International Symposium on Superalloys*, p 191-200, 2008), as well as international specifications (where it is called the "precipitation heat treatment") (See: AMS Specification AMS5951 Rev. A, Nickel Alloy, Nickel Alloy, Corrosion and Heat-Resistant, Sheet, Strip, and Plate, 57Ni-20Cr-10Co-8.5Mo-2.1Ti-1.5Al-0.005B, SAE International (2017) and AMS Specification AMS5915, Nickel Alloy, Nickel Alloy, Corrosion and Heat-Resistant, Bars and Forgings, 57Ni-20Cr-10Co-8.5Mo-2.1Ti-1.5Al-0.005B, SAE International (2014)). The use of a "single-step" age-hardening heat treatment has been explored for 282® alloy (See, for example, S. K. Srivastava, J. L. Caron, and L. M. Pike. "*Recent Developments in the Characteristics of Haynes* 282 *Alloy For Use in A-USC applications", Advances in Materials Technology for Fossil Power Plants*: Proceedings from the Seventh International Conference, Oct. 22-25, 2013 Waikoloa, Hi., USA, p. 120. ASM International, 2014). Typically, these one-step age-hardening treatments are performed at around 1475° F. for 4 to 8 hours. While both heat age-hardening heat treatments described above have received attention and been used in service or in extensive test programs, it has been found that the intermediate temperature ductility resulting from either heat treatment may not be sufficient for all applications.

In certain components in gas turbine engines, particularly in aero engines, it is desired to have intermediate temperature ductilities as high as possible. These components, which may include certain cases and rings, may be required to have good containment properties in the event of an engine failure. Such containment properties are highly dependent on the ductility of the alloy at the operating temperatures, in addition to high strength. While containment properties are best measured by costly special high strain rate tests, a reasonable measure of containment properties can be obtained by consideration of the ductility (elongation) values resulting from a standard tensile test at the relevant temperature. The yield strength (YS) and ultimate tensile strength (UTS) values from the tensile test are also considered. A containment factor, CF, can be calculated from the results of a tensile test and is defined as CF=½*(YS+UTS)*(Elongation). (For this calculation the YS and UTS are in units of ksi and the Elongation is in percentage form.) For applications where containment properties are required, a high value of CF is desired. When comparing CF values for different material conditions, it is important to compare similar product forms and sizes and to use identical sample geometries, since tensile properties can be strongly dependent on product form and size as well as the geometry of the test sample.

The containment factor is dependent on temperature given the fact that the underlying tensile properties are normally temperature dependent. For applications where containment properties are valued the use temperatures may fall in the "intermediate range" of approximately 1200° F. to 1500° F. For this reason, a temperature of 1400° F. was selected for testing of the present invention. A table of 1400° F. tensile properties and the resultant CF values is provided in Table 2 for 282® alloy in both the "standard" age-hardened condition and the "one-step" age-hardened condition. The table only includes data from 0.063" thick sheet. It can be seen that the "standard" age-hardening treatment (heat treat code AHT1) results in a considerably higher CF than the one-step age-hardened condition (heat treat code AHT0), that is, 2751 vs. 1344. While both the YS and UTS are slightly higher in the AHT1 condition, the biggest difference is the significantly lower ductility (elongation) in the AHT0 condition (26.0% vs. 12.9%). While the higher CF value in the AHT1 condition is good, for applications where containment properties are essential an even higher CF value would be desirable. The basis of the present invention is the discovery of new age-hardening heat treatments for 282® alloy which result in even greater ductilities and corresponding CF values.

TABLE 2

1400° F. Tensile Properties and CF of HAYNES ® 282 ® Alloy (0.063"Sheet) in "Standard" and "One-Step" Age-Hardened Conditions

| | Heat Treatment | YS (ksi) | UTS (ksi) | % Elong. | CF |
|---|---|---|---|---|---|
| "One-Step" (AHT0) | 1475° F./8 h | 87.7 | 120.7 | 12.9 | 1344 |
| "Standard" (AHT1) | 1850° F./2 h + 1450° F./8 h | 89.0 | 122.6 | 26.0 | 2751 |

SUMMARY OF THE INVENTION

The principal object of this invention is to provide new age-hardening heat treatments for HAYNES® 282® alloy (UNS N07208) which result in higher material ductilities and corresponding containment factors (CF's) compared to those resulting from previously established heat treatments for the alloy. The new heat treatments involve at least two steps. The first required step is a heat treatment within the temperature range of 1550° F. to 1750° F. (defined here as "Step 1"). The second required step is a heat treatment within the temperature range of 1300° F. to 1550° F. (defined here as "Step 2"). While the lowest temperature in the range for Step 1 is the same as the highest temperature in the range for Step 2 (1550° F.), the temperatures of the two steps should be selected so that there is a decrease in temperatures between the two steps. The duration of the two steps may vary depending upon the size and shape of the product being treated, but each step should be at least two hours. One example is 4 hours for the first step followed by 8 hours for the second step. In addition to these two required steps there is optionally a step in the range of 1850° F. to 1950° F. (defined here as "Step 0") which may be inserted before Step 1. The duration of this step may also vary, but for example may be around 1-2 hours. It has been unexpectedly found that the above described multi-step heat treatments will provide 282® alloy with considerably improved ductility and corresponding containment factor at the intermediate temperature of 1400° F. as compared to previously established heat treatments for the alloy.

DESCRIPTION OF THE PREFERRED EMBODIMENTS

Figure 1:
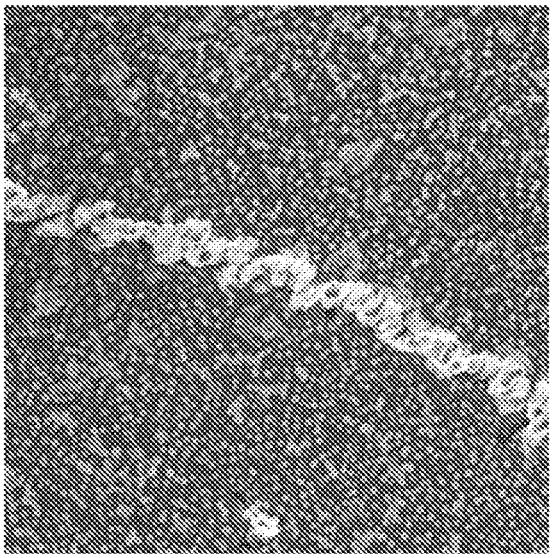
FIG. 1 is a typical SEM image of the grain boundary layer (consisting of both $M_{23}C_6$ and gamma-prime) that is created when the alloy composition within UNS N07208 is heat treated in accordance with my method. In this case the heat treatment is AHT2.

I provide multi-step age-hardening heat treatments for alloy compositions within UNS N07208 which result in improved intermediate temperature ductility and corresponding containment factor relative to previously established age-hardening treatments for said alloy. The multi-step heat treatments require a step at a temperature of 1550° F. to 1750° F. (Step 1) and a subsequent lower temperature step at 1300° F. to 1550° F. (Step 2). The durations of each step may vary, but an example is 4 hours for the first step and 8 hours for the second step. Optionally, a step may be inserted before Step 1. This step (Step 0) would be in the temperature range of 1850° F. to 1950° F. The duration of Step 0 may also vary, but an example is 2 hours. A table illustrating the steps of the new heat treatments for 282® alloy is given in Table 3.

TABLE 3

Multi-Step Age-Hardening Heat Treatments for 282 ® Alloy - 2 Options

| | Step Temperature | |
|---|---|---|
| Step | Option 1 | Option 2 |
| 0 | — | 1850 to 1950° F. |
| 1 | 1550 to 1750° F. | 1550 to 1750° F. |
| 2* | 1300 to 1550° F. | 1300 to 1550° F. |

*Step 2 temperature must be less than the Step 1 temperature

A number of multi-step age hardening heat treatments were applied to samples of 282® alloy. The samples were made from 0.063" sheet which was in the mill annealed (solution annealed) prior to the application of the various age-hardening heat treatments. A list of the heat treatments which are part of the present invention is given Table 4a along with a code to identify each treatment. Other heat treatments outside the present invention were also tested for comparison and are listed in Table 4b.

TABLE 4a

Alternate Heat Treatments (Part of the Present Invention)

| Heat Treatment Code | Step 0 | Step 1 | Step 2 |
|---|---|---|---|
| AHT2 | — | 1650° F./4 h | 1450° F./8 h |
| AHT3 | 1850° F./2 h | 1650° F./4 h | 1450° F./8 h |
| AHT4 | — | 1750° F./4 h | 1450° F./8 h |
| AHT5 | 1850° F./2 h | 1750° F./4 h | 1450° F./8 h |
| AHT10 | — | 1550° F./6 h | 1450° F./8 h |
| AHT12 | — | 1650° F./4 h | 1300° F./8 h |
| AHT13 | — | 1650° F./4 h | 1350° F./8 h |
| AHT14 | — | 1650° F./4 h | 1400° F./8 h |
| AHT15 | — | 1650° F./4 h | 1500° F./8 h |
| AHT16 | — | 1650° F./4 h | 1550° F./8 h |
| AHT17 | — | 1700° F./4 h | 1450° F./8 h |
| AHT18 | 1850° F./2 h | 1550° F./6 h | 1450° F./8 h |
| AHT19 | 1850° F./2 h | 1650° F./4 h | 1300° F./8 h |
| AHT20 | 1850° F./2 h | 1650° F./4 h | 1550° F./8 h |
| AHT21 | 1850° F./2 h | 1700° F./4 h | 1450° F./8 h |

TABLE 4a-continued

| Alternate Heat Treatments (Part of the Present Invention) | | | |
|---|---|---|---|
| Heat Treatment Code | Step 0 | Step 1 | Step 2 |
| AHT22 | 1900° F./2 h | 1650° F./4 h | 1450° F./8 h |
| AHT23 | 1950° F./2 h | 1650° F./4 h | 1450° F./8 h |

TABLE 4b

| Other Heat Treatments Tested (NOT Part of the Present Invention) | |
|---|---|
| Heat Treatment Code | Heat Treatment |
| AHT0 | 1475° F./8 h |
| AHT1 | 1850° F./2 h + 1450° F./8 h |
| AHT6 | 1650° F./8 h |
| AHT7 | 1800° F./2 h + 1450° F./8 h |
| AHT8 | 1500° F./6 h + 1450° F./8 h |
| AHT9 | 1500° F./8 h |
| AHT11 | 1550° F./8 h |

The heat treated samples were tensile tested at 1400° F. to determine their strength, ductility, and containment factor at this critical temperature. Additionally, the microstructures of selected samples were examined using an SEM (scanning electron microscope) to study the effect of the heat treatments on the grain boundary precipitation in the alloy.

The results of the tensile testing are shown in Table 5. The test results provided in Table 2 for AHT0 and AHT1 are reproduced here for comparison purposes.

TABLE 5

| 1400° F. Tensile Test Results - 0.063" Sheet | | | | |
|---|---|---|---|---|
| Heat Treatment | YS (ksi) | UTS (ksi) | % Elong. | CF |
| AHT0 | 87.7 | 120.7 | 12.9 | 1344 |
| AHT1 | 89.0 | 122.6 | 26.0 | 2751 |
| AHT2 | 95.5 | 117.0 | 44.8 | 4758 |
| AHT3 | 95.8 | 116.0 | 42.4 | 4489 |
| AHT4 | 91.8 | 119.5 | 40.8 | 4310 |
| AHT5 | 91.6 | 119.1 | 37.6 | 3957 |
| AHT6 | 80.0 | 115.3 | 28.8 | 2813 |
| AHT7 | 82.2 | 119.5 | 22.7 | 2184 |
| AHT8 | 100.0 | 125.0 | 29.0 | 3263 |
| AHT9 | 98.6 | 124.0 | 28.5 | 3171 |
| AHT10 | 100.2 | 122.9 | 30.0 | 3347 |
| AHT11 | 99.8 | 122.6 | 25.5 | 2836 |
| AHT12 | 92.4 | 119.9 | 42.0 | 4457 |
| AHT13 | 92.8 | 119.1 | 37.0 | 3921 |
| AHT14 | 95.5 | 119.1 | 39.5 | 4237 |
| AHT15 | 94.0 | 116.3 | 43.0 | 4522 |
| AHT16 | 92.7 | 115.5 | 52.0 | 5413 |
| AHT17 | 93.3 | 116.9 | 44.0 | 4625 |
| AHT18 | 96.9 | 123.6 | 29.8 | 3286 |
| AHT19 | 91.0 | 119.2 | 37.0 | 3888 |
| AHT20 | 94.0 | 113.3 | 33.5 | 3472 |
| AHT21 | 94.9 | 116.0 | 43.5 | 4586 |
| AHT22 | 94.4 | 117.6 | 34.5 | 3656 |
| AHT23 | 94.4 | 116.0 | 35.0 | 3682 |

The results show that the 17 heat treatments AHT2 through AHT5, AHT10, and AHT 12 through AHT23 all provided significantly increased ductility (elongation) values compared to heat treatments AHT0 and AHT1. In fact, all 17 of these heat treatments resulted in a tensile ductility of ≥30% (when rounded to the nearest whole number). In contrast, the 7 heat treatments AHT0, AHT1, AHT6 through AHT9, and AHT11 all had tensile ductility values<30%. Furthermore, there was no significant change in the strength of the alloy when given these 17 newly discovered heat treatments (AHT2 through AHT5, AHT10, and AHT 12 through AHT23)—only a very slight change in the UTS was observed (some slightly increased while others slightly decreased) and the YS, in fact, slightly increased in all 17 cases vs. AHT0 and AHT1. In contrast, AHT6 and AHT7 both resulted in a significant drop in the YS vs. any of the other heat treatments studied. This is an unacceptable drop in this key property, therefore neither AHT6 nor AHT7 are considered to be part of the present invention. The combined effect of a significant increase in elongation with no significant change in strength was that the containment factor (CF) was found to significantly increase compared to AHT0 or AHT1 when given any of the 17 heat treatments (AHT2 through AHT5, AHT10, and AHT 12 through AHT23). This is a very desirable result and provides a definite advantage for 282 alloy when used in applications where good containment properties are a requirement. In numerical terms, the CF values of the 282 alloy sheet samples resulting from the 17 heat treatments which are part of the present invention were all found to be ≥3275. In contrast, the CF values resulting from the 7 heat treatments not part of the present invention were all less than 3275.

Of the twenty-four heat treatments considered in Table 5, the 17 which are part of the present invention are AHT2 through AHT5, AHT10, and AHT 12 through AHT23. Only these 17 heat treatments contained both Step 1 and Step 2 as defined in Table 3 and only those 17 heat treatments resulted in the high ductilities and CF values which are the aim of this invention.

To better understand the beneficial effects of the various steps in the heat treatments of the present invention, it is useful to consider the resulting microstructures which are observed in 282® alloy, both before and after heat treatment. First, I will review the as-annealed condition as well as the condition resulting from the previously defined heat treatments (AHT0 and AHT1).

As-Annealed: HAYNES® 282® alloy is normally sold in the as-annealed (or mill annealed) condition. Typical annealing temperatures for 282® alloy range from 2000 to 2100° F. In this condition, there are only a few primary carbides/nitrides present in the microstructure. The grain boundaries and grain interiors are essentially clean of any secondary precipitation. This has been described in the open literature including the technical paper, L. M. Pike, "*Development of a Fabricable Gamma Prime* (γ') *Strengthened Superalloy*", *Superalloys* 2008—*Proceedings of the* 11$^{th}$ *International Symposium on Superalloys*, p 191-200, 2008.

Figure 2:
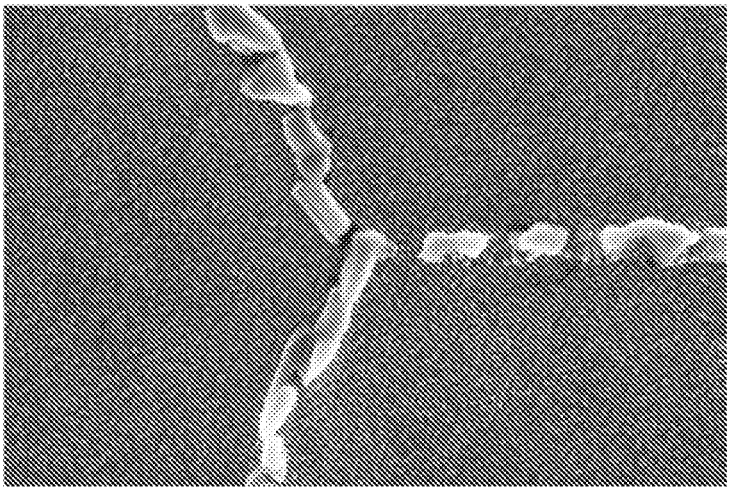
FIG. 2 is a typical SEM image of the grain boundary layer of discrete $M_{23}C_6$ carbides resulting when the alloy composition within UNS N07208 is heat treated using the "standard" two-step age-hardening heat treatment (AHT1).

AHT1: The microstructural features resulting from the "standard" heat treatment (AHT1) are also described in this technical paper. The first step (1850° F./2 h) resulted in the formation of discrete $M_{23}C_6$ carbides located at the grain boundaries and which developed in "stone-wall" configuration. Note that 1850° F. is well above the 1827° F. gamma-prime solvus temperature for 282 alloy. The second step (1450° F./8 h) in AHT1 resulted in the formation of fine gamma-prime phase distributed uniformly throughout the grains. The gamma-prime was essentially spherical in shape with a diameter of approximately 20 nm. No significant build-up or layer of the gamma-prime phase was observed at the grain boundary. An SEM image of a typical 282 alloy grain boundary after the AHT1 heat treatment is shown in FIG. 2.

AHT0: The microstructural features resulting from the "single-step" heat treatment (AHT0) have been described in the technical paper, S. K. Srivastava, J. L. Caron, and L. M. Pike. "*Recent Developments in the Characteristics of*

Figure 3:
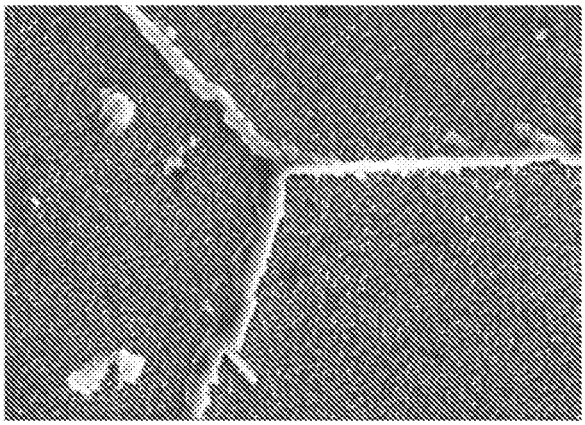
FIG. 3 is a typical SEM image of the grain boundary layer of continuous $M_{23}C_6$ carbides resulting when the alloy composition within UNS N07208 is heat treated using the single-step age-hardening heat treatment (AHT0).

*Haynes* 282 *Alloy For Use in A-USC applications", Advances in Materials Technology for Fossil Power Plants*: Proceedings from the Seventh International Conference, Oct. 22-25, 2013 Waikoloa, Hi., USA, p. 120. ASM International, 2014. There is only one step in this treatment (1475° F./8 h). This step resulted in a more continuous $M_{23}C_6$ layer at the grain boundary compared to the standard treatment. An SEM image of such a grain boundary is given in FIG. 3. Also forming during this single step heat treatment was spherical gamma-prime with a diameter of 38-71 nm—somewhat coarser than the "standard" heat treatment. Again, no significant build-up or layer of the gamma-prime phase is observed at the grain boundary.

Next, I will describe the microstructural features observed resulting from the heat treatments of the present invention. In doing so, each step will be considered separately.

Step 1 (1550 to 1750° F.): This temperature range is well below the 1827° F. gamma-prime solvus temperature for 282® alloy, so it would be expected that the gamma-prime phase should form. Studies of material given a heat treatment in the range of 1550 to 1750° F. have shown that gamma-prime does indeed form. Again, a uniform precipitation of spherical gamma-prime within the grain interiors is observed. However, additionally there is observed a significant amount of gamma-prime phase at the grain boundary in addition to discrete $M_{23}C_6$ carbides. Together these two phases form a complex grain boundary layer. A typical SEM image of this grain boundary layer is shown in FIG. 1. Note that no such layer was found in either of the two previously established heat treatments for 282® alloy (AHT0 or AHT1). While no specific mechanism is offered at this time, it is believed that the complex gamma-prime+$M_{23}C_6$ grain boundary layer formed during the heat treatments of the present invention results in the improved intermediate temperature ductilities and associated containment factors which define this invention. The presence of these grain boundary layers and especially their beneficial effect on the intermediate temperature ductility and containment properties of 282® alloy were unexpected and serve as the basis for the present invention.

Step 2 (1300 to 1550° F.): This temperature range is further below the gamma-prime solvus. Therefore, when Step 2 is applied subsequent to Step 1 the volume fraction of the gamma-prime phase will continue to increase. This increase in gamma-prime further strengthens the alloy providing the high YS required for typical applications. Some additional $M_{23}C_6$ precipitation will also occur.

Step 0 (1850 to 1950° F.): This step is considered as an optional step in the heat treatments of this invention and would be applied prior to Step 1. This step mirrors the first step in the "standard" heat treatment. Therefore, the resultant microstructure is the discrete $M_{23}C_6$ stonewall configuration. Once Step 1 and Step 2 are applied, the microstructure then also includes the gamma-prime layer at the grain boundary as well as the spherical gamma-prime present in the grain interiors.

All of the heat treatments considered here which included both a Step 1 and Step 2 (as defined in Table 3) were found to possess the desired property of improved intermediate temperature ductility and associated containment factor, while at the same time not suffering from a loss in strength. This was true whether or not a Step 0 was applied prior to Step 1. Such heat treatments include AHT2 through AHT5, AHT10, and AHT 12 through AHT23. These are all considered heat treatments of the present invention.

As described above, the presence of a complex gamma-prime+$M_{23}C_6$ layer at the grain boundary is believed to be responsible for the improved intermediate temperature ductility and associated containment factor in 282® alloy provided by the heat treatments of this invention. Such a layer is formed after the application of the Step 1 component of the heat treatments. However, the formation of the layer itself does not fully define the invention. For example, the heat treatment AHT6 includes a Step 1 which provides the complex gamma-prime+$M_{23}C_6$ layer at the grain boundaries. However, AHT6 does not include a Step 2. The result is that less strengthening gamma-prime phase is formed and the YS is considerably lower. In fact, it is too low. Therefore, to achieve the desired YS it is critical that a Step 2 be applied subsequent to Step 1. Additionally, the ductility resulting from AHT6 is also less than the desired 30%. The AHT9 and AHT11 heat treatments are also single step (Step 1 only). Similarly to AHT6, neither AHT9 nor AHT11 have the desired 30% ductility. It appears that single-step heat treatments do not provide the desired combination of acceptable YS and high ductility and CF values in 282 alloy. To achieve such a combination of properties, I have found that heat treatments containing at least two steps (defined as Step 1 and Step 2 in Table 3) are necessary. While the temperature ranges for Step 1 and Step 2 intersect at a temperature of 1550° F., this invention requires a decrease in temperatures between the two steps—therefore, the invention does not cover a heat treatment where both Step 1 and Step 2 are both 1550° F. Such a heat treatment would be essentially the same as a single step heat treatment such as AHT11 which does not meet the desired properties.

Another example where the mere presence of a complex gamma-prime+$M_{23}C_6$ layer is not by itself enough is AHT7. This heat treatment includes a first step and second step, but the first step is at too high of a temperature (1800° F.) compared to the Step 1 range defined in Table 3 (1750° F. max). However, the second step of AHT7 does fall within the Step 2 defined in Table 3. But, while AHT7 is similar to the heat treatments of the present invention, the overly high first step temperature results in a YS lower than is acceptable. Without being held to a specific mechanism, it is believed that this may be a result of the gamma-prime which forms at 1800° F. being too coarse and therefore less effective at strengthening. Therefore, it is important to keep Step 1 at or below the upper limit defined in Table 3. In fact, to further ensure that the gamma-prime phase produced by heat treatment are not too coarse, it is most preferred that the upper temperature limit of Step 1 be lowered to 1700° F.

Additional studies were performed to better understand at what temperatures the gamma-prime layer is formed at the grain boundaries in 282® alloy. In this study, samples of 282® alloy were heat treated for 10 hours at temperatures ranging from 1200 to 2000° F. The samples were examined with an SEM to look for a gamma-prime+$M_{23}C_6$ layer on the grain boundary. The results are given in Table 6. The temperature range where the gamma-prime+$M_{23}C_6$ layer was found was 1500 to 1800° F. However, at 1500° F. the gamma-prime component of the layer appeared less continuous. This fact, combined with the previously discussed AHT0 and AHT1 heat treatments where no gamma-prime was observed at the grain boundary after exposures at 1475 and 1450° F., respectively, suggests that the lower boundary for the formation of the beneficial mostly continuous gamma-prime layer is right around 1500° F. Therefore, to ensure a fully developed layer, it is believed that the lower limit for Step 1 should be set at 1550° F.—comfortably above 1500° F. Since, the upper limit of Step 1 was found to be 1750° F. in the preceding paragraph, the acceptable temperature range of Step 1 is from 1550° F. to 1750° F.

More preferably, to avoid excessive coarsening of the gamma-prime phase, the acceptable temperature range of Step 1 may be further constricted to 1550° F. to 1700° F.

TABLE 6

SEM Investigation - Grain Boundary Precipitation

| Temperature (° F.) | Presence of Gamma-Prime + $M_{23}C_6$ layer on GB |
|---|---|
| 1300 | No |
| 1400 | No |
| 1500 | Yes* |
| 1600 | Yes |
| 1700 | Yes |
| 1800 | Yes |
| 1900 | No |
| 2000 | No |

*Gamma-prime was present, but appeared less continuous.

In the previous two paragraphs the acceptable temperature range of Step 1 was defined based on microstructural arguments. The tensile data shown in Table 5 further supports the validity of the Step 1 temperature range. For example, the 1750° F. upper limit of the range is supported by the high ductility and CF values resulting from AHT4 and AHT5. For the more preferred upper limit of 1700° F. the ductility and CF values of heat treated samples (AHT17 and AHT21) are also high. On the lower end of the Step 1 temperature range (1550° F.), the heat treatments AHT10 and AHT18 were found to result in high ductilities and CF values. Note that the good tensile properties were found across the stated Step 1 temperature range whether or not the optional Step 0 was given prior to Step 1.

Step 1 temperatures that are outside of the defined range may not yield the desired properties. For example, for AHT7 the Step 1 temperature of 1800° F. is above the defined limit. In this case, not only were the ductility and CF values too low (<30% and <3275, respectively), but also the YS undesirably decreased compared to AHT1. Similarly, AHT8 is a heat treatment where the Step 1 heat treatment of 1500° F. is below the defined limit. This heat treatment also results in ductility and CF values which are too low.

As discussed previously, the principal objective of Step 2 is to complete the precipitation of gamma-prime with the objective of increasing strength/hardness to the highest possible. The published study L. M. Pike, "*Development of a Fabricable Gamma-Prime* (γ') *Strengthened Superalloy*", *Superalloys* 2008 —*Proceedings of the* 11$^{th}$ *International Symposium on Superalloys*, p 191-200, 2008, looked at the effect of isothermal aging on the hardness of 282® alloy. Some additional testing has also been performed by the author. In summary, it was found that the maximum hardness was achieved after aging in the range of ~1350 to ~1500° F. A similar isothermal hardening study was published recently which is consistent with the prior studies (M. G. Fahrmann and L. M. Pike, "*Experimental TTT Diagram of HAYNES* 282 *Alloy*", *Proceedings of the* 9*th International Symposium on Superalloy* 718 & *Derivatives: Energy, Aerospace, and Industrial Applications*, E. Ott et al. (Eds.), Jun. 3-6, 2018, The Minerals, Metals, and Materials Society, 2018). The hardness can be expected to roughly correlate with the YS of the alloy. Therefore, based on hardness data the appropriate temperature range for Step 2 of the heat treatment of this invention is 1350 to 1500° F. However, from the tensile data in Table 5, it is clear that the Step 2 range could be expanded to include temperatures from 1300 to 1550° F. This follows from the fact that AHT12 and AHT19 (which both have a Step 2 temperature of 1300° F.) result in acceptable tensile properties, while the same is true for AHT16 and AHT20 (which both include a Step 2 temperature of 1550° F.).

For the optional Step 0, the objective is to form $M_{23}C_6$ at the grain boundary in a discrete, stonewall type configuration prior to the formation of gamma-prime at the grain boundary during Step 1. For this reason, the temperature should be comfortably above the gamma-prime solvus of 1827° F. Since 1850° F. has been consistently shown to be an acceptable temperature to produce such a structure, that serves as the lower temperature for Step 0. The upper limit of Step 0 should be somewhat below the annealing temperature otherwise the grain size is likely to coarsen during the treatment—something not desired for good mechanical properties. Since the annealing temperature for 282® alloy is typically in the range of 2000 to 2100° F., the upper temperature limit should be kept to around 1950° F. or less. Therefore, the temperature range for Step 0 should be 1850 to 1950° F. The tensile data shown in Table 5 support this range. For example, AHT2 is one of six different tested heat treatments where the lower limit Step 0 temperature of 1850° F. resulted in good ductility and CF values. Similarly, AHT23 is an example of where the upper Step 0 temperature of 1950° F. resulted in good ductility and CF values. As a reminder, however, since very good containment properties have been achieved with heat treatments both with and without Step 0, this step is only an optional, not mandatory, component of the heat treatments of this invention.

As mentioned earlier in this text, when considering the effect of the new age-hardening treatments, it is important to test material of the same product form and size. The tensile testing reported in Table 5 was all on 0.063" thick sheet. To get a more complete understanding of the effects of the new heat treatment testing was also performed on both plate and ring material. The results of heat treatment studies on 0.5" plate are provided first. For this study, the 282 plate samples (starting in the mill annealed condition) were subjected to the following heat treatments: AHT1, AHT2, and AHT3. The results are given in Table 7. The two heat treatments of the present invention (AHT2 and AHT3) provided improved ductility and associated CF compared to the AHT1, albeit not as dramatically as was seen in the sheet product. For example, AHT3 resulted in a CF value 25% greater than AHT1 (compared to the 63% increase in sheet product). Nevertheless, the new heat treatments provided a significant difference. Furthermore, no significant loss of strength was observed.

TABLE 7

1400° F. Tensile Test Results - 0.5" Plate

| Heat Treatment | YS (ksi) | UTS (ksi) | % Elong. | % R.A. | CF |
|---|---|---|---|---|---|
| AHT1 | 91.7 | 125.6 | 21.1 | 22.6 | 2292 |
| AHT2 | 89.6 | 119.5 | 23.9 | 24.8 | 2499 |
| AHT3 | 89.7 | 121.1 | 27.1 | 29.3 | 2856 |

Tensile properties were measured of a rolled ring (approximately 24" diameter) subjected to different age-hardening heat treatments subsequent to a solution anneal. The results are shown in Table 8. Again the new heat treatments, AHT2 and AHT3, resulted in a significant improvement in ductility and CF with no appreciable loss of strength. Compared with AHT1, the new AHT2 and AHT3 heat treatments provided a 14 and 26% improvement in the CF, respectively, over AHT1 in the rolled ring samples.

TABLE 8

1400° F. Tensile Test Results - Rolled Ring (24" OD)

| Heat Treatment | YS (ksi) | UTS (ksi) | % Elong. | % R.A. | CF |
|---|---|---|---|---|---|
| AHT1 | 99.5 | 124.8 | 31.8 | 39.2 | 3566 |
| AHT2 | 101.2 | 120.8 | 36.6 | 47.2 | 4063 |
| AHT3 | 98.0 | 121.6 | 40.9 | 55.8 | 4491 |

Even though the samples tested were limited to wrought sheet, plate, and rings, the new heat treatments could reasonably be expected to provide a benefit for other product forms as well. These may include, but are not limited to, other wrought forms (such as bars, tubes, pipes, forgings, and wires) and cast, spray-formed, or powder metallurgy forms, namely, powder, compacted powder, sintered compacted powder, additive manufactured powder, etc. Consequently, the present invention encompasses the defined heat treatments applied to all product forms of 282® alloy (UNS N07208).

Although the testing presented here has all been on HAYNES® 282® alloy (UNS N07208), it is conceivable that the beneficial results of the heat treatments of the present invention may be observed on alloys of similar composition, provided that certain key phases would precipitate at similar temperatures and in similar morphologies. An example may be the full range of compositions covered by U.S. Pat. No. 8,066,938. However, it is not expected that such heat treatments would necessarily be beneficial to all alloys within the same general classification of alloys as 282® alloy (which could be described as the weldable wrought nickel-base gamma-prime formers). The reason for this is that the solvus temperatures of the different key phases (gamma-prime, $M_{23}C_6$, etc.) will vary considerably from alloy to alloy and the morphology of the formed phases could be expected to vary widely from alloy to alloy as well.

Although I have disclosed certain preferred embodiments of the heat treatment, it should be distinctly understood that the present invention is not limited thereto, but may be variously embodied within the scope of the following claims.

I claim:

1. A method for heat treating alloy compositions containing in weight percent:

| | |
|---|---|
| 18.5 to 20.5 | chromium |
| 9.0 to 11.0 | cobalt |
| 8.0 to 9.0 | molybdenum |
| 1.38 to 1.65 | aluminum |
| up to 1.5 | iron |
| 1.90 to 2.30 | titanium |
| 0.04 to 0.08 | carbon |
| up to 0.15 | silicon |
| up to 0.015 | phosphorus |
| up to 0.015 | sulfur |
| 0.003 to 0.010 | boron |
| up to 0.2 | niobium |
| up to 0.5 | tungsten |
| up to 0.1 | tantalum |
| up to 0.1 | copper |
| up to 0.3 | manganese |
| up to 0.1 | zirconium |
| balance | nickel |

comprising:

heating the alloy composition at a temperature between 1550° F. and 1750° F. for at least two hours, and then heating the alloy composition at a lower temperature between 1300° F. and 1550° F. for at least two hours, thereby forming an alloy composition having a complex grain boundary layer containing gamma prime and $M_{23}C_6$ carbide.

2. The heat treatment method of claim 1 also comprising heating the alloy composition at a temperature between 1850° F. and 1950° F. for at least one hour before heating the alloy composition at a temperature between 1550° F. and 1750° F.

3. The method of claim 1 wherein the step of heating the alloy composition at a temperature between 1550° F. and 1750° F. is comprised of heating the alloy composition at a temperature of 1650° F. and is held at that temperature for 4 hours.

4. The method of claim 1 wherein the step of heating the alloy composition at a temperature between 1300° F. and 1550° F. is comprised of heating the alloy composition at a temperature of 1450° F. for 8 hours.

5. The method of claim 1 also comprising heating the alloy composition at a temperature of 1850° F. for 2 hours prior to the step of heating the alloy composition at a temperature between 1550° F. and 1750° F.

6. The method of claim 1 wherein the alloy composition after heat treatment exhibits improved tensile ductility at a temperature of 1400° F. when compared to a tensile ductility of the alloy composition treated according to a standard heat treatment of 1850° F. for 2 hours followed by 1450° F. for 8 hours.

7. The heat treatment method of claim 1 comprising heating the alloy composition at a temperature between 1550° F. and 1700° F. for at least four hours, also comprising heating the alloy composition at a temperature between 1850° F. and 1950° F. for at least one hour before heating the alloy composition at a temperature between 1550° F. and 1700° F.

8. The method of claim 7 wherein the step of heating the alloy composition at a temperature between 1550° F. and 1700° F. is comprised of heating the alloy composition at a temperature is 1650° F. and is held at that temperature for 4 hours.

9. The method of claim 7 wherein the step of heating the alloy composition at a temperature between 1300° F. and 1550° F. is comprised of heating the alloy composition at a temperature is 1450° F. for 8 hours.

10. The method of claim 7 also comprising heating the alloy composition at a temperature of 1850° F. for 2 hours prior to the step of heating the alloy composition at a temperature between 1550° F. and 1700° F.

11. The method of claim 1 comprising, heating the alloy composition at a temperature between 1550° F. and 1750° F. for at least six hours.

12. The heat treatment method of claim 11 also comprising heating the alloy composition at a temperature between 1850° F. and 1950° F. for at least one hour before heating the alloy composition at a temperature between 1550° F. and 1750° F.

13. The method of claim 11 wherein the step of heating the alloy composition at a temperature between 1550° F. and 1750° F. is comprised of heating the alloy composition at a temperature of 1650° F.

14. The method of claim 11 wherein the step of heating the alloy composition at a temperature between 1350° F. and 1500° F. is comprised of heating the alloy composition at a temperature of 1450° F. for 8 hours.

15. The method of claim 11 also comprising heating the alloy composition at a temperature of 1850° F. for 2 hours prior to the step of heating the alloy composition at a temperature between 1550° F. and 1750° F.

16. The method of claim 1 wherein the alloy composition after heat treatment exhibits an improved containment factor at a temperature of 1400° F. when compared to a containment factor at a temperature of 1400° F. of the alloy composition treated according to a standard heat treatment of 1850° F. for 2 hours followed by 1450° F. for 8 hours.

17. The method of claim 1 wherein the step of heating the alloy composition at a temperature between 1550° F. and 1750° F. is comprised of heating the alloy composition at a temperature of at least 1600° F. and the alloy composition is the held at that temperature for at least 2 hours.

* * * * *